US005671489A

United States Patent [19]

Salach

[11] Patent Number: 5,671,489

[45] Date of Patent: Sep. 30, 1997

[54] TONGUE AND GROOVE SHOWER AND BATH SUPPORT SYSTEM

[76] Inventor: Kenneth Salach, 3855 W. Johnson Rd., LaPorte, Ind. 46350

[21] Appl. No.: 396,480

[22] Filed: Mar. 2, 1995

[51] Int. Cl.[6] ..... A47K 3/22

[52] U.S. Cl. ..... 4/614; 4/584; 52/589.1; 52/592.1

[58] Field of Search ..... 4/612–614, 584; 52/34, 35, 589.1, 592.1

[56] References Cited

U.S. PATENT DOCUMENTS

| | | | |
|---|---|---|---|
| 2,004,193 | 6/1935 | Cherry | 52/592.1 X |
| 2,143,034 | 1/1939 | Sakier . | |
| 2,396,845 | 3/1946 | Gruen . | |
| 3,274,743 | 9/1966 | Blum | 52/592.1 X |
| 3,359,574 | 12/1967 | Stoneburner . | |
| 3,605,352 | 9/1971 | Ruggles et al. | 52/35 |
| 3,740,908 | 6/1973 | Moore . | |
| 3,827,086 | 8/1974 | Seymour et al. | 4/584 X |
| 3,978,529 | 9/1976 | Kratft | 4/663 |
| 4,299,064 | 11/1981 | Daniels . | |
| 4,384,377 | 5/1983 | Calvert et al. | 4/614 |
| 4,423,528 | 1/1984 | Wiedmeier . | |
| 4,578,832 | 4/1986 | Primucci . | |
| 4,671,026 | 6/1987 | Wissinger | 4/614 X |
| 4,825,480 | 5/1989 | Moore . | |
| 4,897,889 | 2/1990 | Baus . | |
| 4,901,380 | 2/1990 | Smith . | |
| 4,981,164 | 1/1991 | Reichel . | |
| 4,987,619 | 1/1991 | Smith | 4/614 X |
| 5,303,519 | 4/1994 | Mustee et al. | 52/592.1 X |

*Primary Examiner*—Charles E. Phillips
*Attorney, Agent, or Firm*—Patula & Associates

[57] ABSTRACT

A bathing enclosure comprises a base section and two wall sections. The wall sections are mounted on the base section and are joined by a complimentary tongue and groove. The tongue and groove form a vertical seam which is water-tight, eliminating the need for sealing material. The two-piece wall design provides ease in installation and allows access to areas behind the wall sections it desired or necessary.

7 Claims, 2 Drawing Sheets

TONGUE AND GROOVE SHOWER AND BATH SUPPORT SYSTEM

This invention relates generally to showers and baths, and more particularly a two-piece shower or bath wall construction.

BACKGROUND OF THE INVENTION

Conventional shower stalls and baths and the wall enclosures thereof, consist of an integral one-piece design. The installation of one-piece shower and bath wall enclosures, even when made of fiberglass material, is often very difficult, especially in a remodeling situation, because of the bulky size of the enclosure and the inability to easily fit the enclosure into a relatively small area, such as a bathroom. Additionally, once the one-piece enclosure is in place against a wall or walls, installation of grab bars in the shower or bath wall enclosures is extremely difficult due to limited or even no access to the back of the enclosure and the wall itself.

There does exist prior art multi-piece shower and bath wall enclosures; however, none of these prior art enclosures solve the above-mentioned problems and most require the use of caulking or other types of costly and time consuming sealing methods to prevent leaks. For example, U.S. Pat. No. 3,359,574 issued to Stoneburner, discloses a bathtub having separate end walls and back wall. The back wall and end walls cooperate to form a joint therebetween. Liquid fiberglass bonding material is then used to join the panels so that the panels, in effect, become a single panel. Stoneburner, while perhaps facilitating installation, does not solve the above-mentioned problems in that sealing material is still necessary to prevent leaks, and access to the area behind the back wall is prevented once the back wall is in place.

U.S. Pat. No. 4,299,064 to Daniels discloses a tub surround kit and method of assembly consisting of 4 wall panels, an H-joint and two corner panels. The two wall panels which form the back wall are joined by the H-joint and are sealed with adhesive mastic placed in the grooves of the joint. Further, the separate corner panels are attached to where the sidewalls meet the back wall by applying a pressure sensitive adhesive such as mastic to the back faces of the flanges of the corner panels. Besides being time consuming to install, Daniels differs from the present invention in that no seal material is necessary to prevent leaking between the present invention's two-piece wall construction.

U.S. Pat. No. 3,740,904 to Moore discloses an assembly of interfitting wall panels illustrated as constituting a bathtub surround. Moore's assembly consists of a back wall section which simply is placed over the back wall extensions of the sidewalls and spans a gap therebetween. The back wall section is attached to the back wall extensions of the sidewalls by a continuous band of vertically extending pressure sensitive material which further creates a liquid-proof seam.

U.S. Pat. No. 4,578,832 to Primucci, U.S. Pat. No. 4,901,380 to Smith, and U.S. Pat. No. 4,671,026 to Wissinger, all disclose multi-pieced shower or bath wall enclosures having horizontal seams and which must either be assembled prior to installation, and/or must be provided with sealing panels or sealing material. Assembly of such prior art devices are very time consuming. Further, these prior art assemblies do not solve the above-mentioned problems.

U.S. Pat. No. 4,825,480 to Moore discloses a bathtub and alcove construction having two sidewalls having tongue-like flanges which securely fit into grooves in a one-piece back wall. A silicon adhesive may be applied therebetween for enhancing securement of the received flange. The single back wall of Moore, once installed, prevents access to the area behind the back wall, unlike the present invention, thereby making installation of grab bars extremely difficult.

The present invention solves the above-mentioned problems and limitations of the prior art by providing an easily installed, two-piece shower or bath wall enclosure having a vertical seam. The novel design of the present invention eliminates the need for sealing material and facilitates installation of both the enclosure itself, and grab bars on the enclosure.

BRIEF SUMMARY OF THE INVENTION

The present invention comprises a three-piece shower or bath having a base and two wall sections. The wall sections are joined by a novel tongue and groove joint which allows for ease in installation and eliminates the need for sealing material. The novel design further allows access to the areas behind the wall sections, if necessary, for example to install hand grips.

Accordingly, it is the principle object of the present invention to provide a quick and easy to install shower or bath wall enclosure.

It is a further object of the invention to provide a two-piece shower or bath wall enclosure having a tongue and groove vertical seam.

It is also an object of the invention to provide a leak-proof vertical seam in the shower or bath wall enclosure which eliminates the need for sealing material.

It is an additional object of the present invention to provide a shower or bath wall enclosure which allows access to the area behind the back wall during installation.

It is another object of the invention to provide a two-piece shower or bath wall enclosure which facilitates the installation of grip bars therein.

Numerous other advantages and features of the invention will become readily apparent from the detailed description of the preferred embodiment of the invention, from the claims, and from the accompanying drawings, in which like numerals are employed to designate like parts throughout the same.

BRIEF DESCRIPTION OF THE DRAWINGS

A fuller understanding of the foregoing may be had by reference to the accompanying drawings, wherein.

DETAILED DESCRIPTION OF THE PREFERRED EMBODIMENT OF THE PRESENT INVENTION

Figure 1:
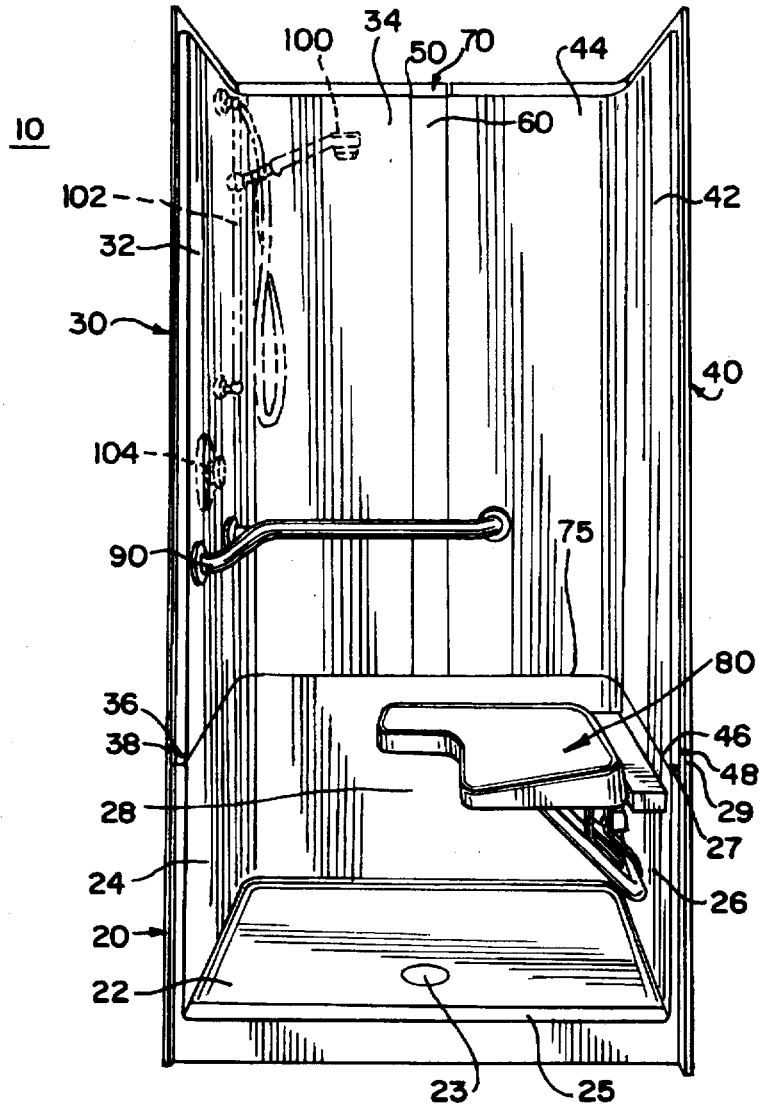
FIG. 1 is a perspective view of the preferred embodiment of the present invention.

While the invention is susceptible of embodiment in many different forms, there is shown in the drawings and will be described herein in detail, a preferred embodiment of the invention. It should be understood, however, that the present disclosure is to be considered an exemplification of the principles of the invention and is not intended to limit the spirit and scope of the invention and/or claims of the embodiment illustrated.

FIG. 1–7 illustrate the present invention 10 in the form of a shower stall comprising a base section 20, a left wall section 30, and a right wall section 40. Left wall section 30 includes groove 50 and right wall section 40 includes tongue 60. Tongue 60 cooperates with groove 50 to form vertical seam 70. It should be understood that the tongue 60 could be on either wall section and the grove 50 on the other.

FIG. 1 shows invention 10 in its assembled position. Base 20 is shown having integral floor 22, sidewalls 24 and 26, and back wall 28. Walls 24, 26 and 28 extend perpendicular to floor 22. Sidewalls 24 and 26 are parallel to each other and perpendicular to back wall 28. Floor 22 includes drain 23 and front curb 25. Front curb extends perpendicular upward a short distance from floor 22 and parallel to back wall 28 and prevents water from a shower from spilling onto the bathroom floor instead of draining down drain 23. Base 20 further has a top surface 27 and mounting flange 29 for receiving and supporting wall sections 30 and 40. Base 20 is further illustrated as having an optional fold-up shower seat 80 attached to sidewall 26.

Wall sections 30 and 40 are shown in assembled position mounted on base 20. Left wall section 30 includes integral sidewall portion 32 and back wall portion 34. Right wall section 40 includes integral sidewall portion 42 and back wall portion 44. Back wall portion 44 of right wall section 40 contains tongue 60 running vertically, substantially the entire length thereof. Similarly, back wall portion 34 of left wall section 30 contains groove 50 running vertically, substantially the entire length thereof. In an assembled position, tongue 60 rests in groove 50 to form vertical seam 70.

Wall sections 30 and 40 further include bottom surfaces 36 and 46, and mounting flange recesses 38 and 48, respectively. In an assembled position, bottom surfaces 36 and 46 rest on top surface 27 of base 20. Mounting flange 29 of base 20 rests in mounting flange recesses 38 and 48 to securely mount wall sections 30, 40 on base 20. Bottom surfaces 36 and 46 meet top surface 27 and form a horizontal seam 75.

FIG. 1 further shows grab bar 90 mounted in any conventional manner to wall sections 30, 40. Showerhead 100 is mounted on showerhead slide bar 102 on left wall section 30 above water control knob 104. Showerhead 100 and water control knob 104 can be any conventional showerhead and control and can be mounted or positioned in any desired location.

Figure 2:
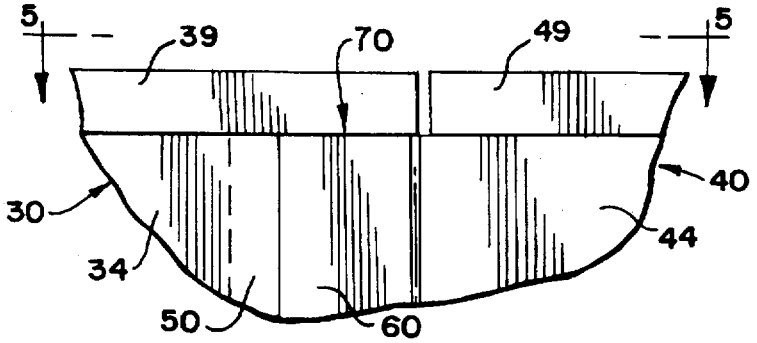
FIG. 2 is a broken away front view of the vertical seam of the present invention at the top end thereof.

FIG. 2 shows a close-up broken away view of the top of vertical seam 70. Tongue 60 of back wall portion 44 rests in groove 50 of back wall portion 34. Wall sections 30 and 40 are shown as having top flanges 39 and 49 respectively.

Figure 3:
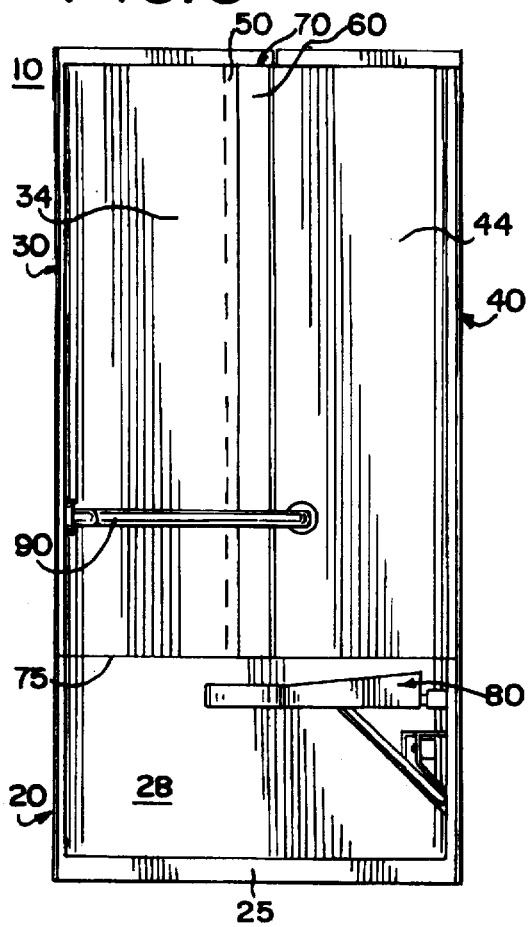
FIG. 3 is a front view of the invention in its assembled position.

FIG. 3 shows a front view of invention 10 in an assembled position. Wall sections 30 and 40 having back wall portions 34, 44 are mounted on base 20, thereby forming horizontal seam 75. Tongue 60 rests in groove 50 to form vertical seam 70. Base 20 with back wall 28 and curb 25 has seat 80 mounted therein. Grab bar 90 is mounted to wall sections 30, 40.

Figure 4:
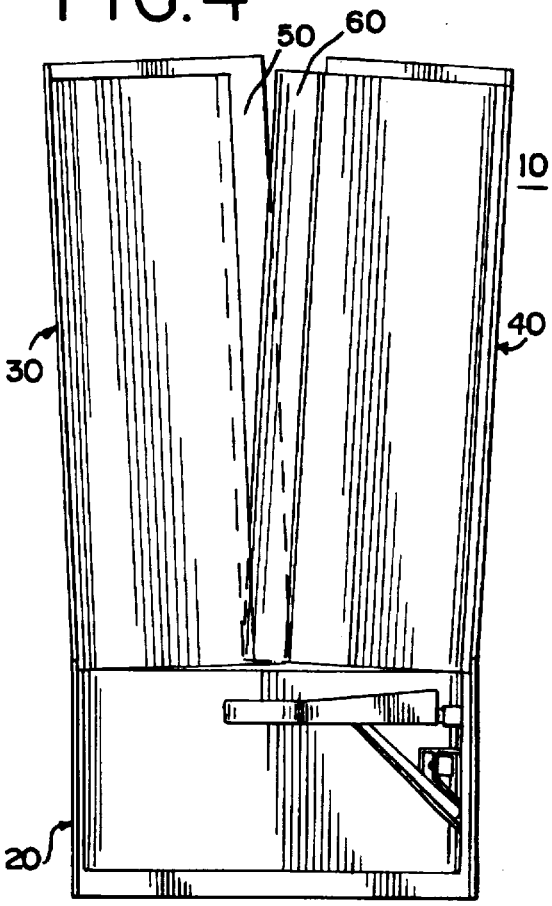
FIG. 4 is a front view of the invention with the wall sections slightly separated.

FIG. 4 shows a front view of invention 10 in which tongue 60 is partially separated from grove 50, illustrating the flexibility of the invention 10. Wall sections 30 and 40 can be easily maneuvered, deformed, or positioned so as to allow for easy installation and mounting on base 20 in small areas and also to allow for access to areas behind the wall sections or to the backs of wall sections 30 and 40 if desired or necessary.

Figure 5:
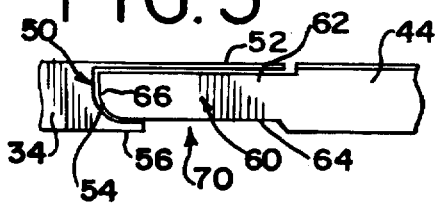
FIG. 5 is a broken away top view of the tongue and groove of the present invention in its assembled position viewed in the direction of line 5—5 of FIG. 2.

FIG. 5 is an enlarged, broken away top view of the tongue and groove of the invention, looking in the direction of line 5—5 of FIG. 2. As shown, tongue 60 of back wall portion 44, sits in groove 50 of back wall portion 34, thereby forming vertical seam 70. Groove 50 comprises an elongated back flange 52, a shallow notch 54 having one curved corner and one squared corner, and a short front flange 56. Tongue 60 comprises a flat back side 62, a flat front side 64 and an end 66. End 66 of tongue 60 has one squared corner and one rounded corner for cooperatively associating with the squared and rounded corners of groove 50. End 66 sits in shallow notch 54. Front flange 56 extends a short distance, partially covering front side 64 of tongue 60. Back flange 52 extends the entire length of tongue 60 such that back flange completely covers flat back side 62 and is in planar juxtaposition therewith. The novel design of tongue 60 and groove 50 forming vertical seam 70 prevents water from leaking behind back wall portions 34 and 44 and eliminates the costly and time consuming need for sealing material such as caulking. The relatively close fit of tongue 60 in groove 50 prevents any substantial amount of water from entering the seam. Any small water particles which do enter seam 70 are trapped in notch 54 and dry up. Should a water particle travel past notch 54, the elongated back flange 52 of groove 50 captures the particle against flat back side 62 of tongue 60. The water particle will diffuse or disperse and dry up without exiting the seam.

Figure 6:
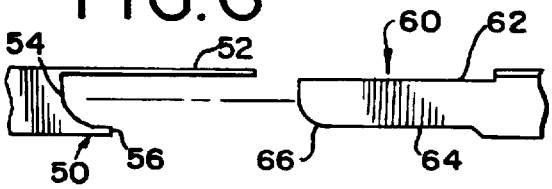
FIG. 6 is a broken away top view of the tongue and groove in a separated position.

FIG. 6 shows tongue 60 separated from groove 50. Tongue 60 comprises back side 62, front side 64, and end 66 having a squared corner and a rounded corner. Groove 50 comprises back flange 52, front flange 56 and notch 54 having a squared corner and a rounded corner for cooperatively associating with the square and rounded corner of end 66 of tongue 60.

Figure 7:
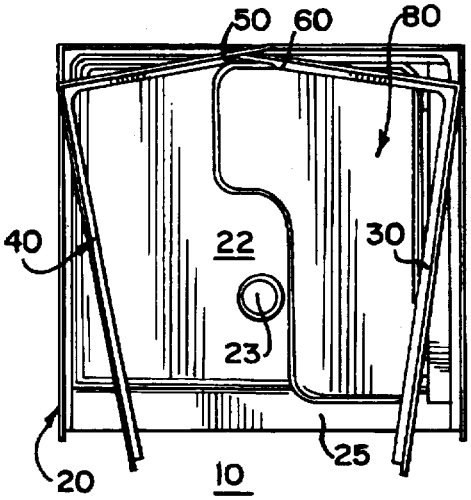
FIG. 7 is a top view of the invention showing the two wall sections positioned for assembly.

FIG. 7 is a top view of invention 10 showing wall section 30 and 40 slightly skewed with respect to each other, again illustrating the invention's ease in assembling and it maneuverability so as to access remote or limited areas. Tongue 60 is shown partially inserted into groove 50. Base 20 is shown having floor 22, drain 23, curb 25 and seat 80.

The invention 10 is preferably made of fiberglass. The invention can be made accessible and/or adaptable to met American Disability Act requirements. The floor can be slip resistant having a reinforced drain. The mounting flanges, walls and floor can similarly be reinforced. Support blocking can be used for grab bars, seats, showerhead slide bar, curtain rod, or any other attachments.

Further, the novel tongue and groove vertical seam could be used in any type or style shower or bath enclosure. The enclosure could have more than two wall sections and incorporate a plurality of tongue and groove seams if desired.

It is to be understood that the embodiments herein described are merely illustrative of the principles of the present invention. Various modifications may be made by those skilled in the art without departing from the spirit and scope of the claims which follow.

I claim:

1. A bathing enclosure for a base section having a plurality of walls, a floor, a drain, a top surface, and a mounting flange, said bathing enclosure comprising:

a first wall section having a wall portion with an end;

a second wall section having a wall portion with an end;

a tongue on said wall portion of said first wall section, said tongue running along substantially the entire vertical length of said end of said wall portion, said tongue includes a flat back surface, a flat front surface and a partially rounded end; and a groove on said wall portion of said second wall section, said groove running along substantially the entire vertical length of said end of said wall portion, said groove includes an elongated back flange, a short front flange, and a notch for receiving said partially rounded end of said tongue;

wherein said groove receives said tongue to create a water-tight sealed vertical seam.

2. The enclosure of claim 1, wherein said partially rounded end of said tongue has a rounded corner and a squared corner.

3. The enclosure of claim 2, wherein said notch of said groove having a complimentary rounded corner and squared corner.

4. The enclosure of claim 1, wherein said back flange extends substantially past said front flange.

5. A bathing enclosure for a base section having a plurality of walls, a floor, a drain, a top surface, and a mounting flange, said bathing enclosure comprising:

a first wall section having a sidewall portion and a back wall portion with an end;

a second wall section having a sidewall portion and a back wall portion with an end;

a tongue on said back wall portion of said first wall section, said tongue running along substantially the entire vertical length of said end of said back wall portion said tongue includes a flat back surface, a flat front surface and a partially rounded end; and a groove on said back wall portion of said second wall section, said groove running along substantially the entire vertical length of said end of said back wall portion, said groove includes an elongated back flange, a short front flange, and a notch for receiving said partially rounded end of said tongue;

wherein said groove receives said tongue to create a water-tight sealed vertical seam.

6. The enclosure of claim 5, wherein said first and second wall sections further define a bottom surface and a mountinq flange recess, said bottom surface of said first and second wall sections rest on said top surface of said base section, and said mounting flange recess of said first and second wall sections receives said mounting flange of said base section when said enclosure is in an assembled position.

7. The enclosure of claim 5 wherein said first and said second wall sections can be maneuvered during installation to allow access to an area behind said wall sections.

* * * * *